US011867060B2

(12) United States Patent
Kollegger et al.

(10) Patent No.: US 11,867,060 B2
(45) Date of Patent: Jan. 9, 2024

(54) REINFORCED CONCRETE TUBBING SEGMENT

(71) Applicant: TECHNISCHE UNIVERSITÄT WIEN, Vienna (AT)

(72) Inventors: Johann Kollegger, Klosterneuburg (AT); Clemens Proksch-Weilguni, Vienna (AT); Hannes Wolfger, Buch-St. Magdalena (AT)

(73) Assignee: TECHNISCHE UNIVERSITÄT WIEN, Vienna (AT)

( * ) Notice: Subject to any disclaimer, the term of this patent is extended or adjusted under 35 U.S.C. 154(b) by 148 days.

(21) Appl. No.: 17/428,342

(22) PCT Filed: Feb. 4, 2020

(86) PCT No.: PCT/AT2020/060030

§ 371 (c)(1),
(2) Date: Aug. 4, 2021

(87) PCT Pub. No.: WO2020/160582

PCT Pub. Date: Aug. 13, 2020

(65) Prior Publication Data

US 2022/0025766 A1 Jan. 27, 2022

(30) Foreign Application Priority Data

Feb. 4, 2019 (AT) ..... A 60022/2019
May 14, 2019 (AT) ..... A 50433/2019

(51) Int. Cl.
*E21D 11/08* (2006.01)

(52) U.S. Cl.
CPC ..... *E21D 11/08* (2013.01)

(58) Field of Classification Search
CPC ..... E21D 11/08; E21D 11/083; E21D 11/086
See application file for complete search history.

(56) References Cited

U.S. PATENT DOCUMENTS 1,969,810 A 8/1934 Mcalpine
3,818,710 A * 6/1974 Chlumecky ..... E21D 11/385 405/152
4,836,714 A * 6/1989 Matiere ..... E21D 11/083 405/153
5,035,538 A * 7/1991 Mitchell ..... E21D 11/05 405/152

(Continued)

OTHER PUBLICATIONS

International Search Report, English Translation, and Written Opinion from PCT/AT2020/060030, filed Feb. 4, 2020, dated May 14, 2020.

*Primary Examiner* — Carib A Oquendo
(74) *Attorney, Agent, or Firm* — Workman Nydegger

(57) ABSTRACT

The invention relates to a tunnel lining segment of reinforced concrete, wherein the tunnel lining segment has a load transfer area for a longitudinal joint, with at least one steel bar with an end face being installed in the tunnel lining segment, the steel bar being arranged in the tunnel lining segment in such a way that a tangent to a centroidal axis of the steel bar encloses an angle of between 0° and 45° in the end face with a normal to the load transfer area, and wherein the end face is arranged at a distance (a) from the load transfer area which is between 0 mm and 50 mm, preferably between 0 mm and 10 mm.

20 Claims, 10 Drawing Sheets

(56) References Cited

U.S. PATENT DOCUMENTS

| | | | | |
|---|---|---|---|---|
| 2003/0113168 | A1* | 6/2003 | Naka | E21D 11/40 405/153 |
| 2016/0053614 | A1* | 2/2016 | Recher | E21D 11/04 405/152 |
| 2019/0309625 | A1* | 10/2019 | Riechers | E21D 9/0607 |

* cited by examiner

REINFORCED CONCRETE TUBBING SEGMENT

BACKGROUND OF THE INVENTION

Background and Relevant Art

The invention relates to a tunnel lining segment made of reinforced concrete, the tunnel lining segment having a load transfer area for a longitudinal joint.

Tunnel tubes are often constructed with tunnel lining segment rings using shield driving. When this construction method is applied, the tunnel tube consists of tunnel lining segment rings arranged one behind the other in the longitudinal direction of the tunnel. Each tunnel lining segment ring is composed, for example, of six to ten individual tunnel lining segments distributed across the circumference of the tunnel lining segment ring. The tunnel lining segments are manufactured in proximity to the tunnel tube as prefabricated parts made of reinforced concrete. The so-called ring joint is located between two adjacent tunnel lining segment rings. The so-called longitudinal joint is located between the tunnel lining segments of a tunnel lining segment ring.

The tunnel tube is loaded by its own weight and by compressive forces acting in the radial direction from the mountains or the soil material adjacent to the tunnel tube. In construction practice, the radial compressive forces often occur in different magnitudes along the longitudinal extension of the tunnel tube. The tunnel lining segments usually have a constant thickness within a tunnel tube. Accordingly, the dimensioning of the thickness of the tunnel lining segments is done for the maximum value of the radial compressive forces, or special tunnel lining segments made of steel are used in the more heavily loaded sections of the tunnel tube. However, steel tunnel lining segments are considerably more expensive than reinforced concrete tunnel lining segments.

The load transfer area in the longitudinal joint between two tunnel lining segments made of reinforced concrete is smaller than the cross-sectional area of the tunnel lining segments. The cross-sectional area of a tunnel lining segment in a radial section results from the product of the width $b_1$ and the thickness $d_1$. The width $b_1$ of a tunnel lining segment or, respectively, a tunnel lining segment ring in the longitudinal direction of the tunnel usually ranges between 1.5 m and 2.5 m. The thickness $d_1$ of a tunnel lining segment usually ranges between 0.2 m and 0.7 m.

In order to avoid spalling at the edges of the prefabricated tunnel lining segments made of reinforced concrete and to enable the tunnel lining segments to be installed more easily, the load transfer area required for transferring the compressive force in the direction of the ring in a longitudinal joint is manufactured with a width $b_0$, which is smaller than the width $b_1$, and a thickness $d_0$, which is smaller than the thickness $d_1$. Therefore, only one area resulting from the product of the width $b_0$ and the thickness $d_0$ is available in the load transfer area in the longitudinal joints.

The width $b_0$ is approximately 85% to 95% of the width $b_1$. The thickness $d_0$ is approximately 45% to 55% of the thickness $d_1$. In order to allow the cross-sectional reduction in the longitudinal joint to be estimated, the size of the load transfer area is calculated using the mean values of the ranges indicated above (90% and 50%). The result is that the load transfer area is only 45% of the cross-sectional area of the tunnel lining segment. For calculating the compressive force absorbable by the load transfer area, the uniaxial design compressive strength $f_{cd}$ of the concrete may be enlarged by the factor $$k_c = \sqrt{\frac{b_1 \cdot d_1}{b_0 \cdot d_0}}$$

according to the specifications of ÖNORM EN 1992-1-1, Section 6.7. This factor equals 1.49 for the above-indicated example in which the load transfer area $b_0 \cdot d_0$ equals 45% of the cross-sectional area $b_1 \cdot d_1$.

The compressive force that can be transmitted in the longitudinal joint for a longitudinal joint with a uniaxial design strength of the concrete equaling $f_{cd}$ in case of a centric load will then be $$b_0 \cdot d_0 \cdot f_{cd} \cdot k_c = 0.45 \cdot b_1 \cdot d_1 \cdot f_{cd} \cdot 1.49 = 0.67 \cdot b_1 \cdot d_1 \cdot f_{cd}.$$

This corresponds to 67% of the compressive force which can be absorbed in the tunnel lining segment's cross-sections remote from the longitudinal joint. For the dimensioning of the thickness $d_1$ of a tunnel lining segment, proof of the load transfer in the longitudinal joint is therefore crucial.

Therefore, numerous proposals to increase the compressive force absorbable in a longitudinal joint between two reinforced concrete tunnel lining segments have been drawn up in the past.

One way of increasing the compressive force absorbable in a longitudinal joint is described in AT 518 840 A1. In a first tunnel lining segment and in a second tunnel lining segment, which, in the installed state, are stressed by a compressive force in the load transfer area of the longitudinal joint, reinforcing bodies are incorporated in the areas of the tunnel lining segments which are adjacent to the longitudinal joint. The reinforcing bodies are made of steel or stainless steel. The dimension of a force transmission body in the direction of the thickness of the tunnel lining segment corresponds to the tunnel lining segment thickness $d_1$. The height of the force transmission body is chosen to be so large that the compressive force can be propagated from the load transfer area to the underside of the force transmission body and the concrete on the underside of the force transmission body is stressed evenly with the areas $b_1$ by $d_1$. In this way, the force transmission problem in the longitudinal joint is solved.

The solution shown in AT 518 840 A1 is disadvantageous in that

- the reinforcing bodies are made of steel or stainless steel and are therefore expensive to manufacture,
- the reinforcing bodies made of steel on the outside of the tunnel tube may corrode and the progression of the corrosion process cannot be assessed from the inside of the tunnel, and
- the reinforcing bodies will quickly lose their load-bearing capacity in the event of a fire.

In EP 1 243 753 A1, coupling elements made of steel are described, which can be arranged in a ring joint and in a longitudinal joint. The coupling elements enable a form-fitting connection with a spring element running as a complementary coupling element across the greater part of the length of the second tunnel lining segment. A steel insert can also be concreted into the surface of a tunnel lining segment according to the invention, which surface is located on the side of the longitudinal joint. Furthermore, the entire surface of the tunnel lining segment on the side of the longitudinal joint can be formed by the steel insert. The solution shown in EP 1 243 753 A1 is disadvantageous in that

- the coupling elements are made of steel and are therefore expensive to manufacture,
- the coupling elements made of steel and arranged in the longitudinal joint may corrode, and
- the coupling elements will quickly lose their load-bearing capacity in the event of a fire.

In DE 25 22 789 C3, tunnel lining segments with a reinforcement constructed of elongated elements made of ductile cast iron are described. Via a binding agent that is introduced into an interspace, a compressive force is transmitted from an element made of ductile cast iron onto a bearing and from there onto an end element. The solution shown in DE 25 22 789 C3 is disadvantageous in that

- the end elements and the bearings are made of a metallic material and are therefore expensive to manufacture,
- the end elements arranged in the longitudinal joint may corrode, and
- the end elements will quickly lose their load-bearing capacity in the event of a fire.

BRIEF SUMMARY

Another embodiment for a tunnel lining segment with elements made of steel in a longitudinal joint is described in JP 1 502 207 from the year 1975. The reduction of the cross-sectional area in the longitudinal joints, which is customary in modern tunnel construction involving tunnel lining segments, is not illustrated in JP 1 502 207. Box-shaped recess elements made of steel are installed in the sides of the tunnel lining segments which are adjacent to the longitudinal joint. These recess elements allow two adjacent tunnel lining segments to be connected with a screw connection. In addition, it is disclosed that reinforcing bars are welded to the recess elements. These reinforcing bars primarily serve for the attachment of the recess elements in the tunnel lining segment. However, when a compressive force is transmitted in the longitudinal joint, they will absorb part of the compressive force, passing it into the concrete of the tunnel lining segment. The solution shown in JP 1 502 207 is disadvantageous in that

- the recess elements are made of steel and are therefore expensive to manufacture,
- the recess elements arranged in the longitudinal joint may corrode, and
- the recess elements will quickly lose their load-bearing capacity in the event of a fire.

Another embodiment for a tunnel lining segment with elements made of steel in a longitudinal joint is described in JP 11 287 093 A. The reduction of the cross-sectional area in the longitudinal joints, which is customary in modern tunnel construction involving tunnel lining segments, is not illustrated in JP 11 287 093 A. C-shaped steel elements, which are anchored in the tunnel lining segment with reinforcing bars that have been screwed in, are installed in the sides of the tunnel lining segments which are adjacent to the longitudinal joints. During the assembly of the tunnel lining segments, connecting elements made of steel are pushed into the C-shaped steel elements. Moreover, JP 11 287 093 A shows that the end faces of the C-shaped steel elements have, in the installed state, a distance S which is double the distance T. A pressure transfer in the longitudinal joints across the C-shaped steel elements is therefore not possible in a tunnel lining segment ring.

A further embodiment for a tunnel lining segment with reinforcing bars in the area of the longitudinal joint is described in U.S. Pat. No. 1,969,810. The tunnel lining segments are reinforced with reinforcing bars arranged in the direction of the ring. At the time of this disclosure in 1931, only reinforcing bars with smooth surfaces were available. In order to achieve better anchoring of the reinforcing bars in the concrete, it is therefore suggested that the ends of the reinforcing bars are widened or a V-shaped anchoring is produced. Furthermore, it is suggested that the longitudinal joints of the tunnel lining segments in adjacent tunnel lining segment rings are offset against one another in order to ensure that the normal compressive force in a tunnel lining segment ring in the area of the longitudinal joint is passed across the ring joint into the adjacent tunnel lining segment ring and is partially absorbed there by the reinforcing bar. This load transfer mechanism is known as the "circumferential zig-zag path".

This load transfer mechanism does not work in reality since the ring joints may open as a result of the shrinkage of the concrete. In the thirties of the last century, there was not yet enough knowledge available about the shrinkage behaviour of concrete.

It is the object of the present invention to provide a tunnel lining segment which, compared to the tunnel lining segments currently used in modern tunnel construction, has a higher load-bearing capacity and which can be produced less expensively in comparison to known tunnel lining segments and has a higher durability as well as a longer duration of fire resistance.

This object is achieved by a tunnel lining segment made of reinforced concrete, wherein the tunnel lining segment has a load transfer area for a longitudinal joint, with at least one steel bar with an end face being installed in the tunnel lining segment, the steel bar being arranged in the tunnel lining segment in such a way that a tangent to a centroidal axis of the steel bar encloses an angle of between 0° and 45° in the end face with a normal to the load transfer area, and wherein the end face is arranged at a distance from the load transfer area which is between 0 mm and 50 mm, preferably between 0 mm and 10 mm.

Due to the steel bars arranged according to the invention in the tunnel lining segment—which advantageously are provided in addition to the reinforcement of the concrete—said tunnel lining segment can be produced less expensively in comparison to the tunnel lining segments of the prior art, while still having a higher durability and duration of fire resistance. Besides, due to the steel bars of the tunnel lining segment, a particularly good force transmission on the load transfer area is achieved, which is located between the tunnel lining segment and a further tunnel lining segment belonging to the same tunnel lining segment ring.

Tests performed on the tunnel lining segment according to the invention have shown that load transfer through the steel bars still happens even if the specified distance is greater than 0 mm and, for example, concrete is located between the end face of the steel bar and the load transfer area. Notably, it is particularly preferred if two or more steel bars are provided in the tunnel lining segment in the arrangement according to the invention.

The steel bar is preferably a corrugated reinforcing bar, as a result of which an improved transmission of force to the concrete is achieved in the area of the longitudinal joint. Alternatively, a steel bar without fins can be used as well.

In one embodiment, the steel bar could be straight, for example, if it has a length that is less than a third of the length of the tunnel lining segment in the circumferential direction. The steel bar preferably has a curvature which essentially corresponds to a curvature of the tunnel lining segment in order to enable improved installation.

The steel bars are preferably installed at a distance from the centre plane of the tunnel lining segment. As a result, a guide bar can be installed in the load transfer area in the centre plane of the tunnel lining segment.

It is advantageous if the steel bar is installed in the tunnel lining segment in such a way that a concrete cover is provided between a surface of the steel bar and an edge of an overpressed zone of the load transfer area, as a result of which the steel bar has a greater durability in comparison to an arrangement outside of the overpressed zone.

The steel bar preferably has a diameter of between 10 mm and 100 mm, particularly preferably of between 20 mm and 50 mm, whereby a good compromise is achieved between the suitability for force transmission and weight or, respectively, costs.

As already stated, the concrete from which the bigger part of the tunnel lining segment is made can, for example, be arranged at the distance mentioned. Alternatively, however, it may also be provided that an expansion of the steel bar is provided adjacent to the above-mentioned distance, which entails an even better force transmission.

In the embodiment as mentioned, the expansion can be, for example, an end piece that has been screwed on, a steel plate that has been welded on or a thickening of the steel bar. The expansion can be made from the same material as the steel bar.

It is beneficial if the steel bar has a length which corresponds to a developed length of the tunnel lining segment minus twice the distance. The steel bar can thus run through the entire length of the tunnel lining segment and effect a force transmission at both ends of the tunnel lining segment. Alternatively, shorter steel bars could each be provided separately in the arrangement according to the invention at both ends of the tunnel lining segment.

If the length of the steel bar corresponds to a developed length of the tunnel lining segment minus twice the distance, it is particularly preferred if the expansion of the steel bar is provided adjacent to one of the distances. Such tunnel lining segments can be installed in a tunnel lining segment ring in such a way that an end of the steel bar without an expansion is, in each case, oriented toward an end of a steel bar having an expansion. Two different types of tunnel lining segments therefore do not have to be used for such structures.

Furthermore, at least two of the aforementioned steel bars are preferably installed in the tunnel lining segment, the two steel bars being arranged on a common plate which has a higher compressive strength than the concrete of the tunnel lining segment. The force transmission from two or more steel bars can thus be effected planarly, which indeed makes the construction of the tunnel lining segment more difficult, but further improves the force transmission.

In the embodiment as mentioned, the plate is preferably made of steel and both steel bars are welded to the plate, whereby the steel plate can have a particularly durable design and can be connected to the steel bars.

It is beneficial if the end face of the steel bar encloses an angle with the centroidal axis of the steel bar, which ranges between 60° and 90°, preferably between 75° and 90°. Thus, according to the invention, the steel bar can have an end face which is inclined with respect to the centroidal axis in order to individually adapt the space enclosed between the load transfer area and the end face.

In a further preferred embodiment, a hardened mortar, which has a higher compressive strength than the concrete of the tunnel lining segment, is located at the specified distance, the mortar being particularly preferably located in a recess which was formed by a filling material that was removed after the concrete had hardened. As a result, the distance can be filled in such a way that the load transfer area receives a more durable design.

During manufacture, the tunnel lining segment preferably has a formwork which is at a distance of 0.1 mm and 50 mm, preferably 0.1 mm and 10 mm, from the end face of the steel bar.

Furthermore, the steel bar is preferably a corrugated reinforcing bar which is arranged in the ring direction on the inside and/or the outside of the tunnel lining segment and is manufactured with two bends in the area of the longitudinal joint so that two different sections of the steel bar run parallel to a circumferential direction of the tunnel lining segment. With this construction of the tunnel lining segment, a reinforcing bar already provided for the tunnel lining segment can be adapted in order to design it as a steel bar according to the invention. This has the advantage that no additional steel bars are introduced into the tunnel lining segment so that weight and costs can be reduced.

The advantages according to the invention of the individual tunnel lining segment become apparent in particular when several of those tunnel lining segments are assembled to form a tunnel lining segment ring. A particularly preferred tunnel lining segment ring can be achieved in that it comprises at least a first tunnel lining segment and a second tunnel lining segment according to the embodiments listed above, the load transfer areas of the tunnel lining segments being located, at least partially, opposite one another so that a longitudinal joint is formed between them, wherein the tangent to the centroidal axis in the end face of the steel bar of the first tunnel lining segment intersects with the load transfer area at a first point of intersection and wherein the tangent to the centroidal axis in the end face of the steel bar of the second tunnel lining segment intersects with the load transfer area at a second point of intersection, with the first and the second points of intersection being at a distance from one another which is less than 50 mm, preferably less than 10 mm. In this tunnel lining segment ring, two tunnel lining segments according to the invention with steel bars are thus arranged in such a way that a transmission of force from the steel bar of one tunnel lining segment to the steel bar of the other tunnel lining segment is effected.

With the aforementioned tunnel lining segment ring, it is beneficial if the steel bar of the first tunnel lining segment has a different diameter than the steel bar of the second tunnel lining segment. In this case, the tunnel lining segments can have steel bars of different thicknesses at their ends so that the tunnel lining segment ring can be produced from identical tunnel lining segments, for example.

Furthermore, the first and the second tunnel lining segments are preferably arranged relative to each other in such a way that the assembly inaccuracies in a longitudinal joint formed between them are less than 20 mm, preferably less than 10 mm, which, in practice, provides sufficient accuracy for the tunnel lining segment ring according to the invention.

In the following, the invention is described on the basis of non-limiting exemplary embodiments illustrated in the drawings. The following is shown, in each case, in schematic illustrations:

DETAILED DESCRIPTION

For the sake of clarity, the seals, fasteners, centering means and injection lines usually required in the manufacture of tunnel tubes 11 using shield driving involving tunnel lining segments 12, as well as the reinforcement inserted in the tunnel lining segments 12 are not illustrated in FIGS. 1 to 23. The reinforcement in a tunnel lining segment 12 may consist of reinforcing steel, steel fibres, plastic fibres and of a stainless steel reinforcement.

In the following, reference is first made to FIGS. 1 to 6, in which the production of an exemplary longitudinal joint 13 with a tunnel lining segment 12 according to the invention in accordance with a first embodiment is described.

Figure 1:
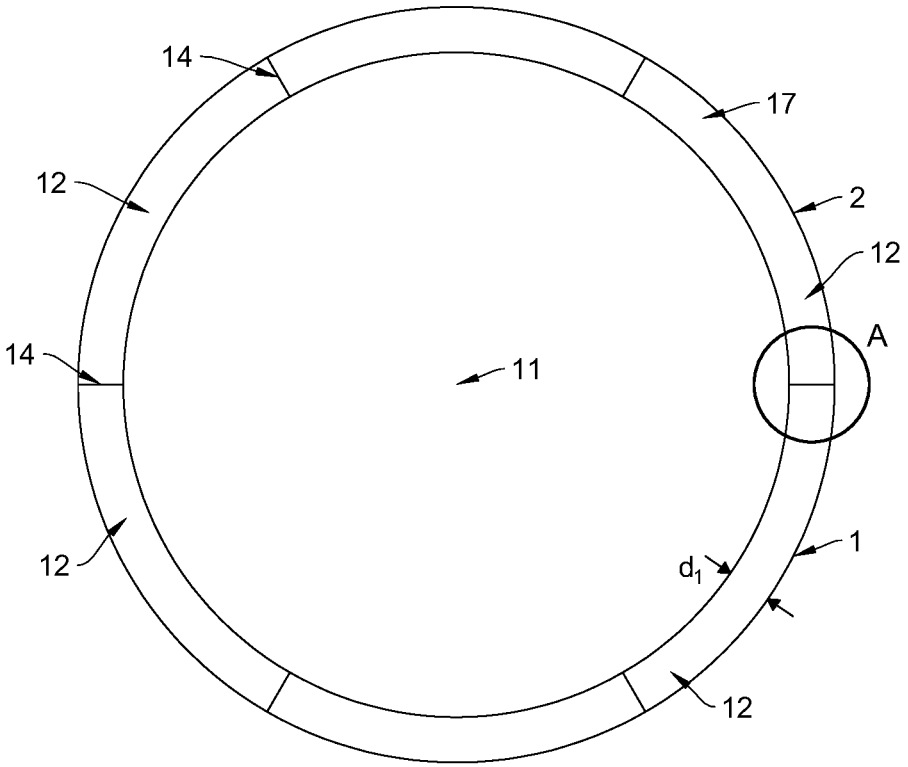
FIG. 1 shows a cross-section through a tunnel tube comprising six tunnel lining segments.

FIG. 1 shows a section through a tunnel tube 11 composed of six tunnel lining segments 12. The tunnel lining segments 12 have a thickness $d_1$. Longitudinal joints 13 are arranged between the tunnel lining segments 12. The six tunnel lining segments 12 form a tunnel lining segment ring 17. The tunnel lining segment ring 17 is stressed mainly by normal compressive forces. Bending moments in the tunnel lining segment ring 17 are caused by assembly inaccuracies during the manufacture of the tunnel lining segment ring 17 and by the load created by dead weight.

Figure 2:
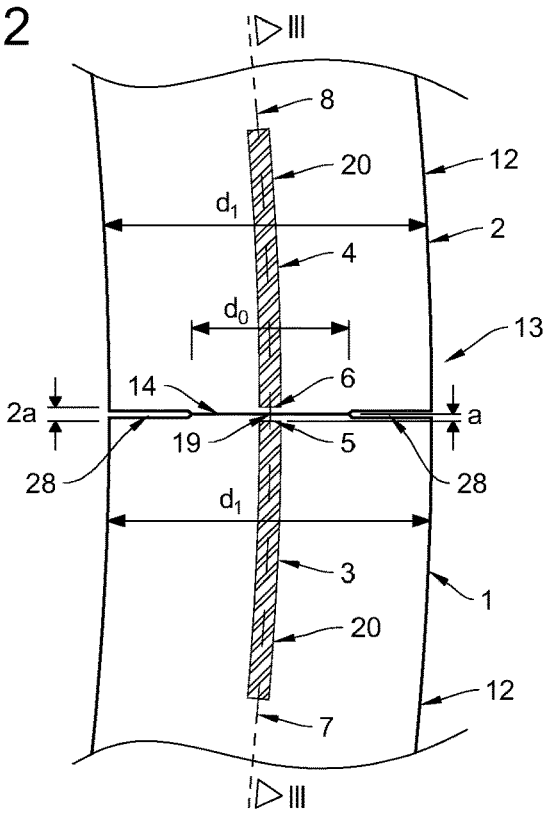
FIG. 2 shows the detail A of FIG. 1.

FIG. 2 shows that, in the longitudinal joint 13 between a first tunnel lining segment 1 and a second tunnel lining segment 2, which hereinafter are also referred to as tunnel lining segments 12, the thickness $d_1$ of the tunnel lining segments 12 is reduced to the thickness do in the load transfer area 14. During the manufacture of a tunnel lining segment 12, the outer regions of the end faces at the longitudinal joints 13 are displaced by, for example, 3 to 5 mm relative to the load transfer area 14. As a result, recesses 28 with a height of, for example, 6 to 10 mm are formed in the longitudinal joint 13.

Figure 3:
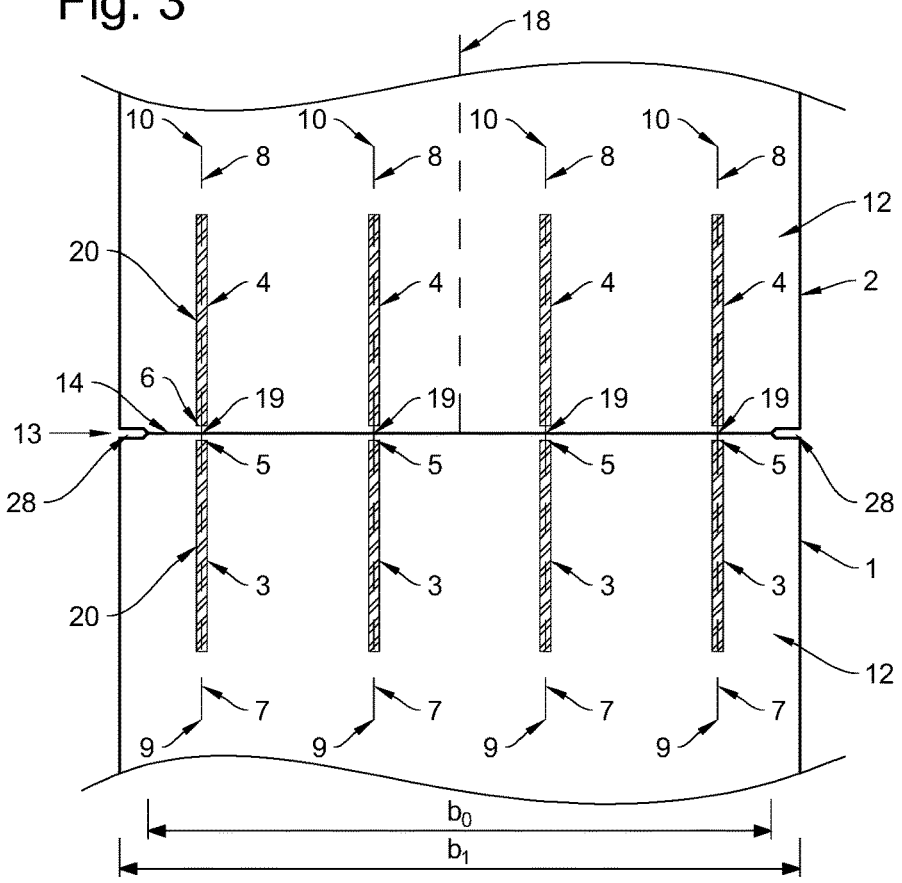
FIG. 3 shows a section along the line III-III in FIG. 2.

FIG. 3 shows that the width $b_1$ of the tunnel lining segments 12 in the area of the longitudinal joint 13 is reduced to the width $b_0$. The load transfer area 14 results from the product of the width $b_0$ and the thickness do. The load transfer area 14 is smaller than the cross-sectional area of a tunnel lining segment 12, which results from the product of the width $b_1$ and the thickness $d_1$.

In order to increase the normal compressive force absorbable in the load transfer area 14, first steel bars 3 are installed in the first tunnel lining segment 1 and second steel bars 4 are installed in the second tunnel lining segment 2. The tangent 9 to the centroidal axis 7 in the end face 5 of a first steel bar 3 and the tangent 10 to the centroidal axis 8 in the end face 6 of a second steel bar share the same points of intersection 19 with the load transfer area 14 because, in this example, the first steel bars 3 and the second steel bars 4 are installed exactly opposite each other and no offset occurs in the longitudinal joint 13 during the assembly of the tunnel lining segments 1 and 2. The steel bars 3 and 4 have a curved shape and consist of corrugated reinforcing bars 20.

The end face 5 of the first steel bar 3 and the end face 6 of the second steel bar 4 each have the distance a from the load transfer area 14. A concrete layer having the height **2*a* is therefore located between the end faces 5, 6. Our own tests have shown that it is possible to transmit the force of a first steel bar 3, which results from the area of the first steel bar 3 and the yield stress of the steel, to the second steel bar 4** across the concrete layer. Through this transmission of force, triaxial compressive stresses arise in the thin concrete layer, which are much higher than the maximum uniaxial compressive stress of the concrete that can be absorbed.

Figure 4:
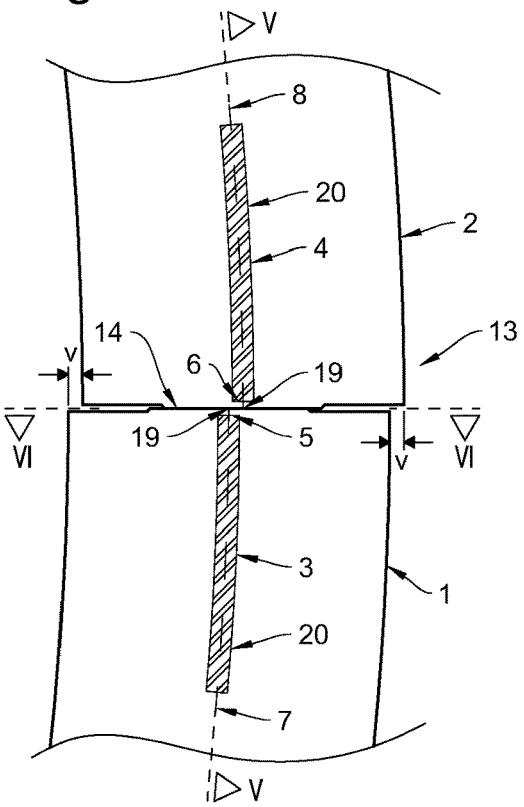
FIG. 4 shows a detail corresponding to FIG. 2 with tunnel lining segments which are mutually offset in the direction of the thickness.
Figure 5:
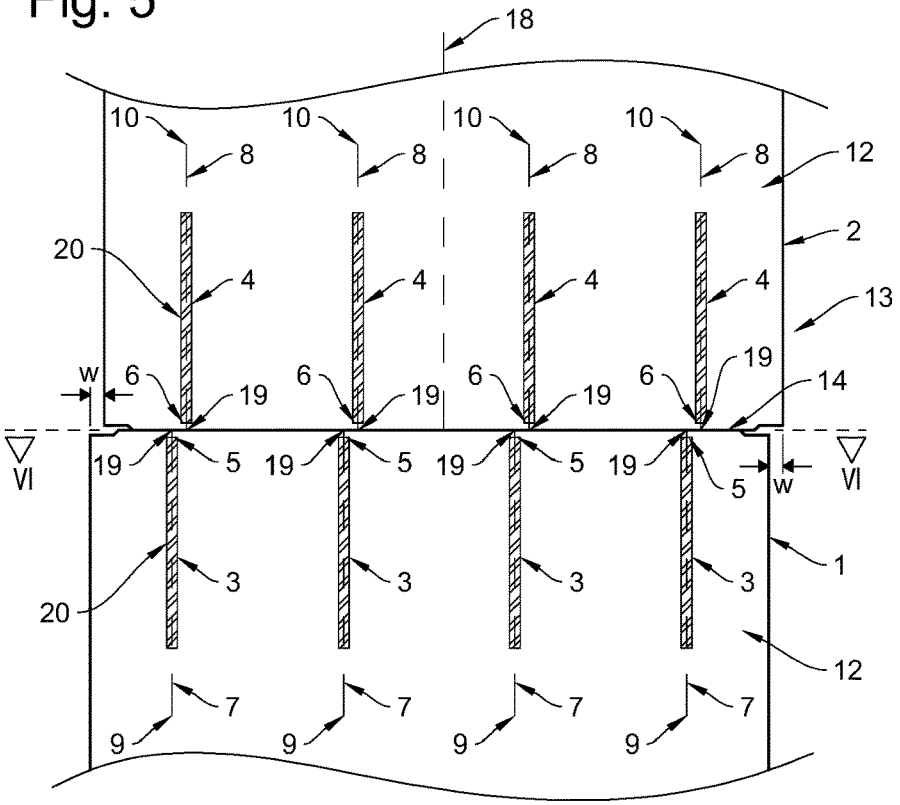
FIG. 5 shows a section corresponding to FIG. 3 with tunnel lining segments which are mutually offset in the direction of the width.

FIG. 4 shows a detail corresponding to FIG. 2 with a first tunnel lining segment 1 and a second tunnel lining segment 2, which, as a result of assembly inaccuracies, exhibit a mutual offset v in the direction of the thickness. FIG. 5 shows a section corresponding to FIG. 3 with a first tunnel lining segment 1 and a second tunnel lining segment 2, which exhibit a mutual offset w as a result of assembly inaccuracies.

Figure 6:
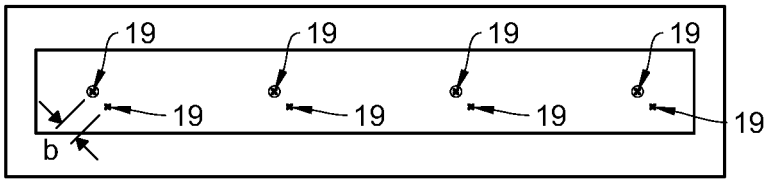
FIG. 6 shows a section along the line VI-VI in FIG. 4 and FIG. 5.

FIG. 6 shows that, as a result of those assembly inaccuracies, the points of intersection 19 of the tangents 9 to the centroidal axes 7 in the end faces 5 of the first steel bars 3 with the load transfer area 14 and the points of intersection 19 of the tangents 10 to the centroidal axes 7 in the end faces 6 of the second steel bars 4 with the load transfer area 14 have a distance b.

The force that can be transmitted in the concrete layer depends on the height 2*a* of the concrete layer and on the cross-sectional area of the steel bars. If the ratio between the height 2*a* of the concrete layer and the diameter of the steel bars 3, 4 is greater than 0.15, the full load capacity of a first steel bar 3 can no longer be transferred to a second steel bar 4. The arrangement of the steel bars 3, 4 with a mutual distance b, which is illustrated in FIGS. 4 to 6, also reduces the force transferable across the concrete layer.

Figure 7:
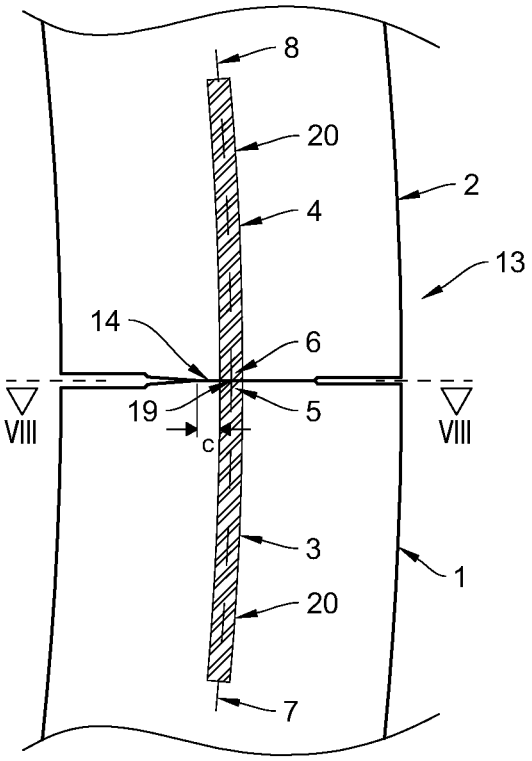
FIG. 7 shows a section corresponding to FIG. 2 through a longitudinal joint produced with the tunnel lining segment according to the invention, in accordance with a second embodiment.
Figure 8:
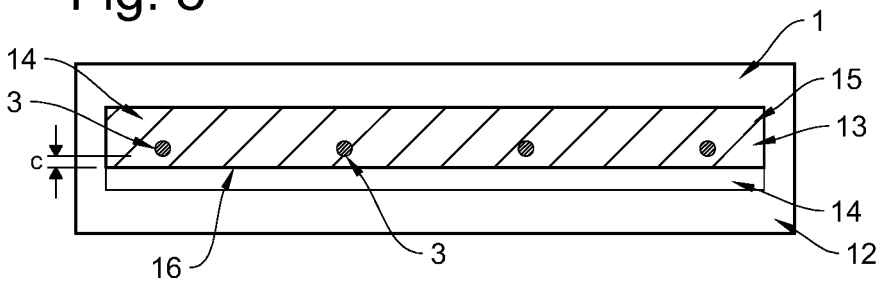
FIG. 8 shows the section VIII-VIII of FIG. 7.

The manufacture of an exemplary longitudinal joint 13 with the tunnel lining segment 12 according to the invention in accordance with a second embodiment is explained in FIGS. 7 and 8.

FIG. 7 shows that a first steel bar 3 and a second steel bar 4 are installed in such a way that the end face 5 and the end face 6 touch one another. The points of intersection 19 of the tangents 9 and 10 with the load transfer area 14 are at the same location.

The longitudinal joint illustrated in FIGS. 7 and 8 is stressed by a normal compressive force and a bending moment. For this reason, the overpressed zone 15, which is illustrated in shaded mode in FIG. 8, is smaller than the load transfer area 14, which would appear in case of a centric loading of the longitudinal joint 13 with a normal compressive force.

For the durability of the steel bars 3 and 4, it is particularly beneficial that a concrete cover c is present between the edge 16 of the overpressed zone 15 and the surface of the steel bars 3 and 4.

Figure 9:
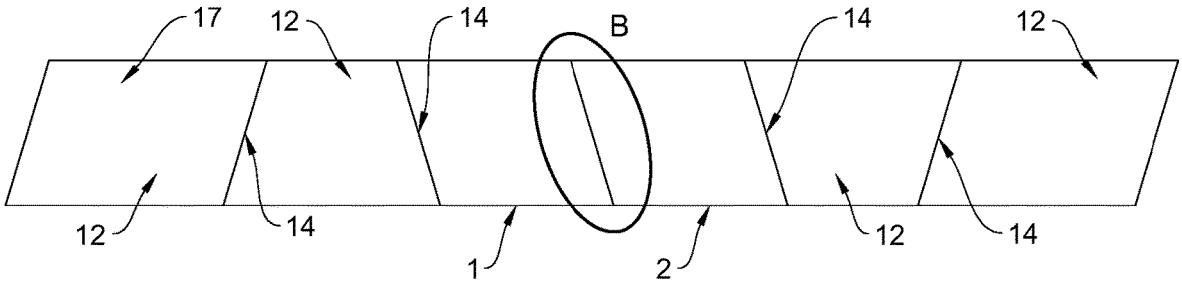
FIG. 9 shows an unwound tunnel lining segment ring with longitudinal joints, which were produced with the tunnel lining segment according to the invention, in accordance with a third embodiment.
Figure 10:
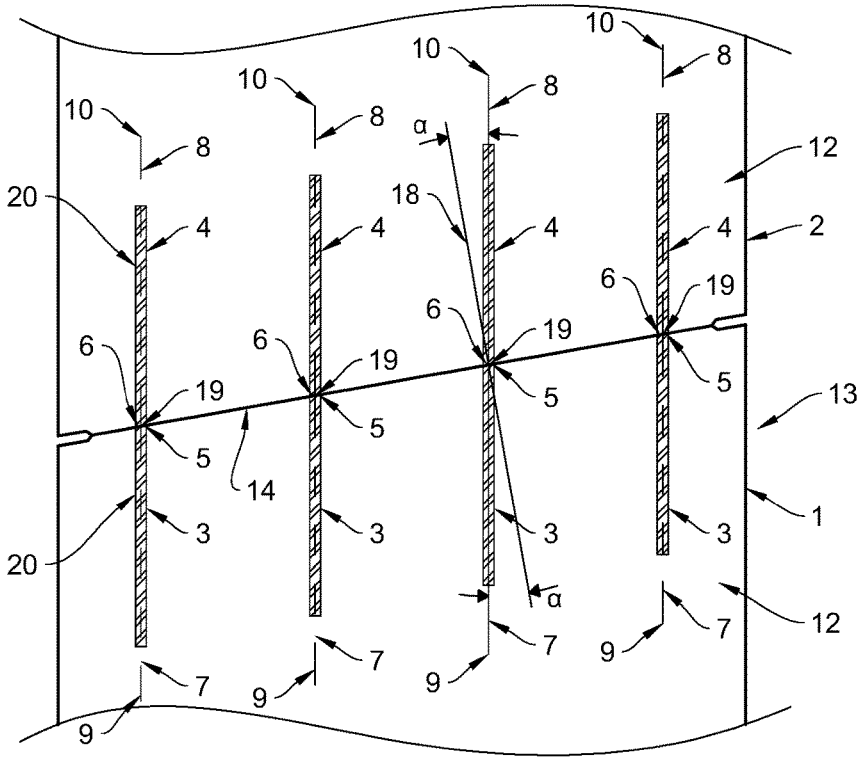
FIG. 10 shows the detail B of FIG. 9.

The manufacture of an exemplary longitudinal joint 13 with the tunnel lining segment 12 according to the invention in accordance with a third embodiment is explained in FIGS. 9 and 10.

FIG. 9 shows the unwinding of a tunnel lining segment ring 17 composed of six tunnel lining segments 12. In this view, the tunnel lining segments 12 have the shape of a diamond or a trapezoid. The longitudinal joints 13 are therefore not parallel to the longitudinal axis of the tunnel tube 11.

FIG. 10 shows that, due to the arrangement of the longitudinal joints 13 as illustrated in FIG. 9, an angle $\alpha$ arises between the centroidal axes 7 and 8 of the steel bars 3 and 4 and the normal 18 to the load transfer area 14, since the steel bars 3 and 4 are installed in parallel to the side surfaces of the tunnel lining segments 12, the side surfaces being arranged in the ring joints.

In this exemplary embodiment, the steel bars 3 and 4 are sawn off at an angle $\alpha$ to the centroidal axes 7 and 8. Accordingly, the end faces 5 of the first steel bars 4 enclose an angle $\alpha$ with the centroidal axes 7. The end faces 6 of the second steel bars 4 enclose an angle $\alpha$ with the centroidal axes 8. As a result, a butt joint between the first steel bars 3 and the second steel bars 4 is produced in the longitudinal joint 13. A butt joint ensures a particularly effective transmission of the compressive forces between the first steel bars 3 and the second steel bars 4.

Figure 11:
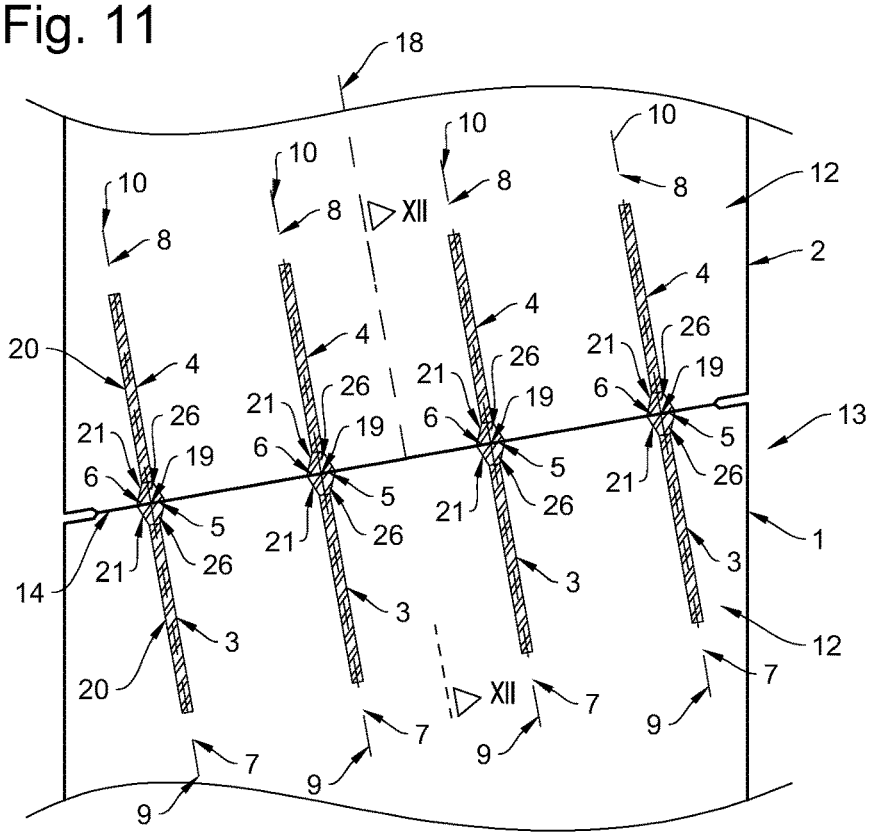
FIG. 11 shows a detail corresponding to FIG. 9 of a longitudinal joint produced with the tunnel lining segment according to the invention, in accordance with a fourth embodiment.
Figure 12:
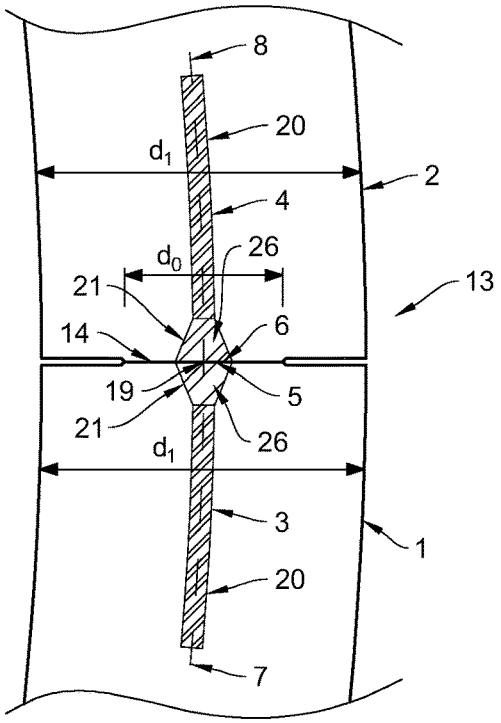
FIG. 12 shows the section XII-XII of FIG. 11.

The manufacture of an exemplary longitudinal joint 13 with the tunnel lining segment 12 according to the invention in accordance with a fourth embodiment is explained in FIGS. 11 and 12.

In this exemplary embodiment, the steel bars 3 and 4 are installed in such a way that the tangents 9 and 10 are parallel to the normal 18 to the load transfer area 14. FIGS. 11 and 12 show that, in addition to the end faces 5 and 6 of the steel bars 3 and 4, expansions 21 have been produced. For example, the expansions 21 may consist of end pieces 26 made of steel, which are screwed onto the threaded ends of the steel bars 3 and 4. It would also be possible to weld steel plates to the ends of the steel bars 3 and 4 in order to produce an expansion 21.

It would also be possible to apply a thickening in and next to the end faces 5 and 6 of the steel bars 3 and 4 by thermal and/or mechanical processes in order to produce an expansion.

Figure 13:
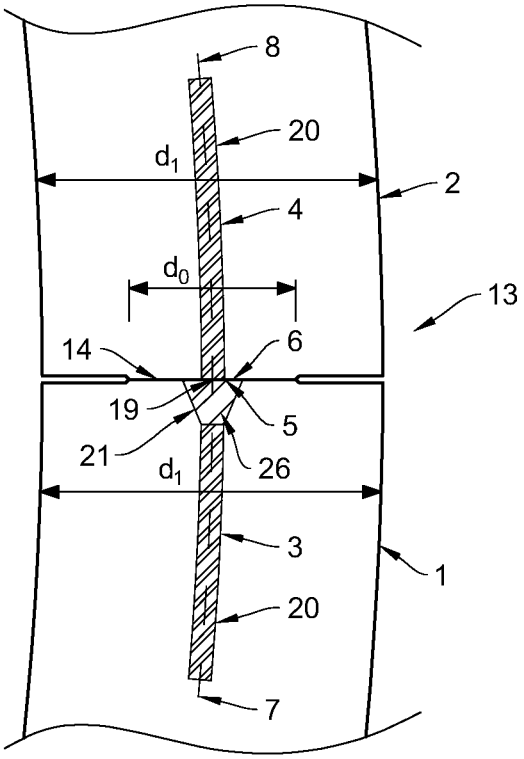
FIG. 13 shows a section corresponding to FIG. 12 through a longitudinal joint produced with the tunnel lining segment according to the invention, in accordance with a fifth embodiment.

The manufacture of an exemplary longitudinal joint 13 with the tunnel lining segment 12 according to the invention in accordance with a fifth embodiment is explained in FIG. 13.

In this exemplary embodiment, at least one first steel bar 3 with an expansion 21 is produced and installed in a first tunnel lining segment 1 in such a way that the opposite at least one second steel bar 4 has a constant diameter.

Figure 14:
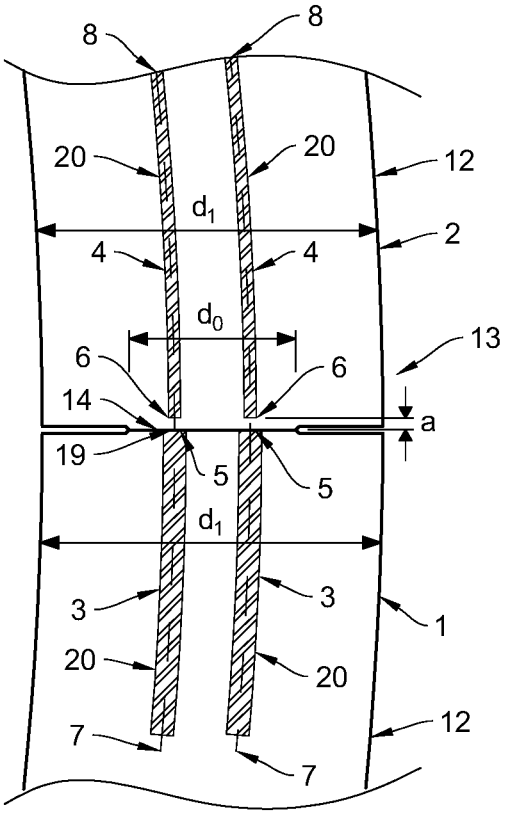
FIG. 14 shows a section corresponding to FIG. 2 through a longitudinal joint produced with the tunnel lining segment according to the invention, in accordance with a sixth embodiment.

The manufacture of an exemplary longitudinal joint 13 with the tunnel lining segment 12 according to the invention in accordance with a sixth embodiment is explained in FIG. 14.

In this exemplary embodiment, the first steel bars 3 and the second steel bars 4 are installed in such a way that the steel bars 3 and 4 are at a distance from the centre planes of the tunnel lining segments 1 and 2. The diameter of the first steel bars 3 is larger than the diameter of the second steel bars 4.

The first steel bars 3 are installed in such a way that the end faces 5 will lie directly in the plane of the load transfer area 14. The second steel bars 4 are installed in such a way that they will have a distance a between the end faces 6 and the load transfer area 14. The length of the second steel bars 4 corresponds to the developed length of the tunnel lining segment 2 minus twice the distance a. Maintaining the distance a between the load transfer area 14 and the end faces 6 as planned serves for the compensation of manufacturing tolerances.

Figure 15:
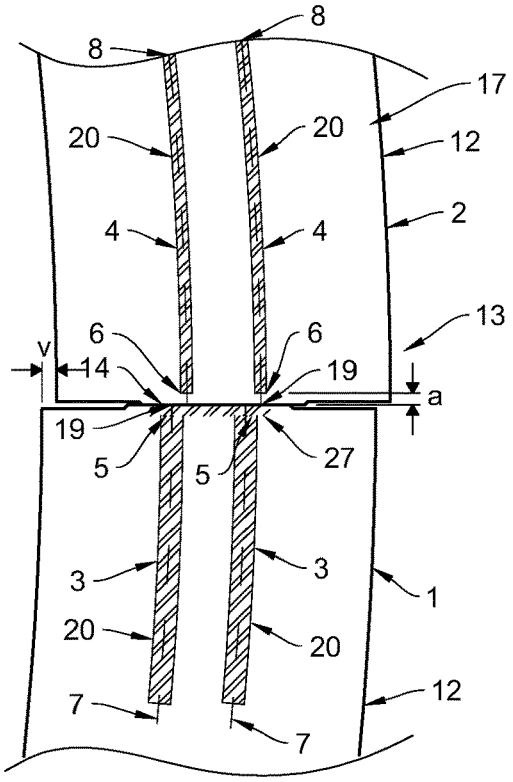
FIG. 15 shows a section corresponding to FIG. 2 through a longitudinal joint produced with the tunnel lining segment according to the invention, in accordance with a seventh embodiment.

The manufacture of an exemplary longitudinal joint 13 with the tunnel lining segment 12 according to the invention in accordance with a seventh embodiment is explained in FIG. 15.

In this exemplary embodiment, at least two first steel bars 3 are fastened on a plate 27. In this exemplary embodiment, the plate 27 is made of steel and the steel bars 3 are fastened by means of a welding process. The plate 27 could also be manufactured from another metallic construction material, ultra-high-strength concrete, a ceramic construction material or a synthetic material. In this example it is advantageous that the end faces 6 of the second steel bars 4 displaced by an offset v are removed from the surface of the steel plate 27 embedded in the first tunnel lining segment 1 only by the dimension a. As our own investigations have shown, the transmission of the compressive forces through the concrete layer arranged between the end faces 5 and 6 of the first steel bars 3 and the second steel bars 4 is more effective if the distance a is small. Since, in this example, the end faces 6 of the second steel bars 4 are removed from the steel plate only by the dimension a even in case of an offset v, this example represents a particularly advantageous embodiment.

In this exemplary embodiment, the second steel bars 4 have a length which corresponds to the developed length of the second tunnel lining segment 2 minus twice the distance a. If the tunnel lining segment ring 17 is composed, for example, of six tunnel lining segments 12, three first tunnel lining segments 12 with plates 27 made of steel are configured in the longitudinal joints 13, and three second tunnel lining segments 2 with second steel bars 4 which have a length corresponding to the developed length of the second tunnel lining segments 2 minus twice the distance a.

When dimensioning the length and the width of a plate 27, it is necessary—if the plate is made of a corrosion-prone construction material such as, e.g., steel—to make sure that the plate 27 can be arranged in the overpressed zone 15 of the load transfer area 14.

In this exemplary embodiment, at least two first steel bars 3 arranged in the thickness direction of the tunnel lining segment 1 are fastened on a common plate 27. It would also be possible to arrange at least two steel bars 3 arranged in the direction of the width of the tunnel lining segment 1 on a common plate 27.

The attachment of at least two first steel bars 3 on a plate 27 and the attachment of at least two second steel bars 4 on a further plate 27 would be possible, but would entail an increased effort in the tunnel lining segment production and bring about only an insignificant increase in the load-bearing capacity of the longitudinal joint 13 of the tunnel lining segment, since the basic idea of the present invention is that the compressive force from a first steel bar 3 can be transmitted to a second steel bar 4 either directly or through a thin concrete layer. A necessary prerequisite for this support mechanism is that the thickness a or, respectively, 2*a* of the concrete layer between the end faces 5 and 6 of the steel bars 3 and 4 is small or equal to zero.

Figure 16:
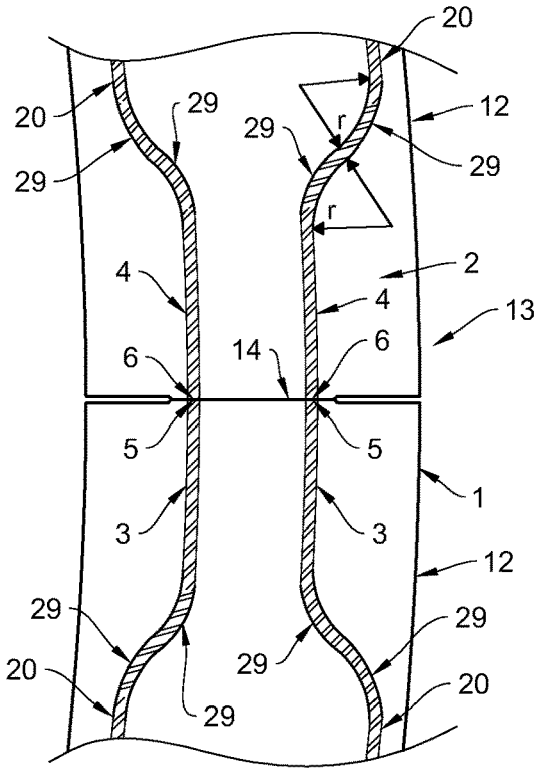
FIG. 16 shows a section corresponding to FIG. 14 through a longitudinal joint produced with the tunnel lining segment according to the invention, in accordance with an eighth embodiment.

The manufacture of an exemplary longitudinal joint 14 with the tunnel lining segment 12 according to the invention in accordance with an eighth embodiment is explained in FIG. 16.

In this exemplary embodiment, the corrugated reinforcing bars 20, which are laid in the ring direction on the inside and outside and which form part of the reinforcement of the tunnel lining segment 12, are equipped close to the longitudinal joint 13 with two bends 29 each with a radius r so that the corrugated reinforcement bars 20 move away from the inside or, respectively, the outside of the tunnel lining segment 12, as a result of which two different sections of the steel bar 3 run parallel to a circumferential direction of the tunnel lining segment 1. The end faces of the steel bars 3 and 4 are arranged in the load transfer area 14 of the longitudinal joint 13. In this embodiment, the longitudinal reinforcement of the tunnel lining segment 12, which exists anyway and, in the customary embodiment, is immaterial for the load-bearing capacity of the tunnel lining segments 12 close to the longitudinal joint 13, is used for increasing the load-bearing capacity of the longitudinal joint 13. The corners of the tunnel lining segments 12 can be prevented from chipping off by the arrangement of bow-shaped reinforcing bars with small diameters. Those bow-shaped reinforcing bars are not illustrated in FIG. 16 for the sake of clarity.

The manufacture of an exemplary longitudinal joint 13 with the tunnel lining segment 12 according to the invention in accordance with a ninth embodiment is explained in FIGS. 17 to 20.

Figure 17:
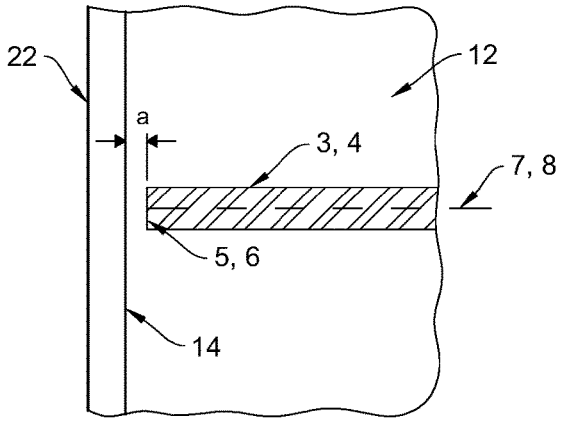
FIG. 17 shows a view of a first steel bar installed in a formwork or a second steel bar for a longitudinal joint to be produced with the tunnel lining segment according to the invention, in accordance with a ninth embodiment.

FIG. 17 shows that a first steel bar 3 or a second steel bar 4 is installed in a formwork 22 for a tunnel lining segment 12 in such a way that it is at a distance a from the load transfer area 14.

Figure 18:
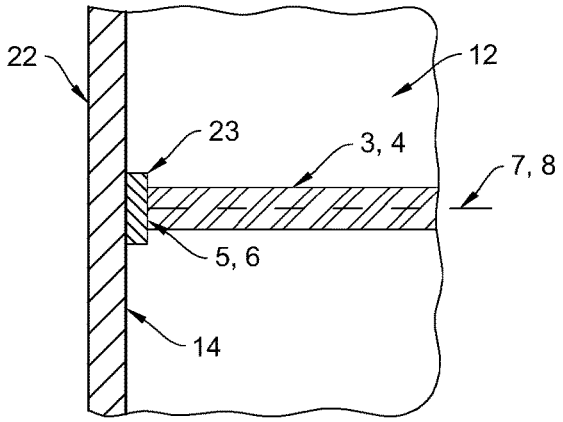
FIG. 18 shows a view corresponding to FIG. 17 after the incorporation of a filling material.

FIG. 18 shows that, before or after the installation of the steel bar 3 or 4, a filling material 23 is incorporated between the end faces 5 or 6 and the formwork 22. The filling material 23 may consist, for example, of extruded polystyrene, an elastomer or wood.

Figure 19:
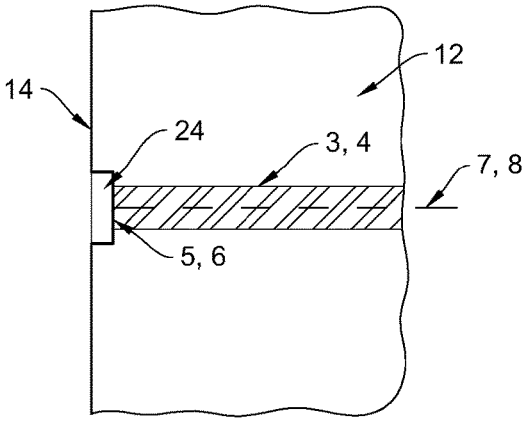
FIG. 19 shows a view corresponding to FIG. 18 after the removal of the filling material.

FIG. 19 shows that after the concrete of the tunnel lining segment 12 has hardened, the formwork 22 and the filling material 23 are removed so that a cavity 24 is created.

Figure 20:
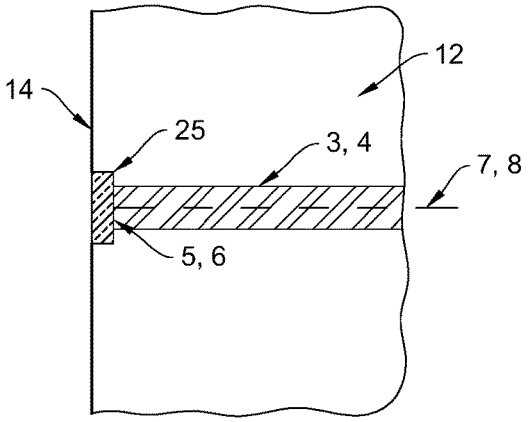
FIG. 20 shows a view corresponding to FIG. 19 after the filling of the cavity with mortar.

FIG. 20 shows that, subsequently, a mortar 25 is introduced into the cavity 24. The mortar 25 may consist, for example, of a trowelable mortar that has a strength of 50 $N/mm^2$ to 200 $N/mm^2$ and preferably of 60 $N/mm^2$ to 120 $N/mm^2$ in the hardened state.

Figure 21:
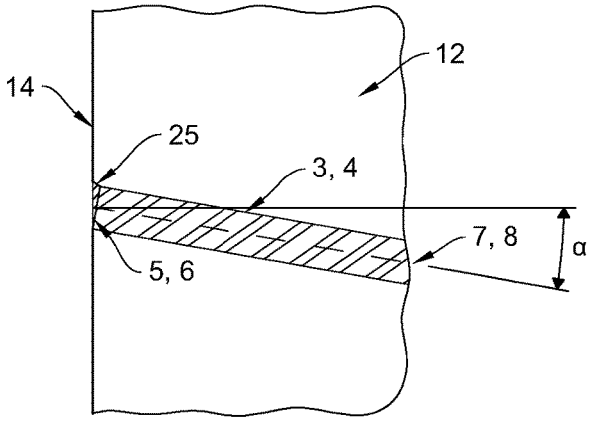
FIG. 21 shows a view corresponding to FIG. 20 after the filling of the cavity with mortar through a longitudinal joint to be produced with the tunnel lining segment according to the invention, in accordance with a tenth embodiment.

The manufacture of an exemplary longitudinal joint 13 with the tunnel lining segment 12 according to the invention in accordance with a tenth embodiment is explained in FIG. 21.

FIG. 21 shows that a steel bar 3 or 4 is installed in such a way that the tangent 9 or 10 has an angle $\alpha$ to the normal 18 onto the load transfer area 14 and that the end face 5 or 6 touches the load transfer area. The thickness of the layer of mortar 25 which fills the cavity 24 is therefore not constant.

Figure 22:
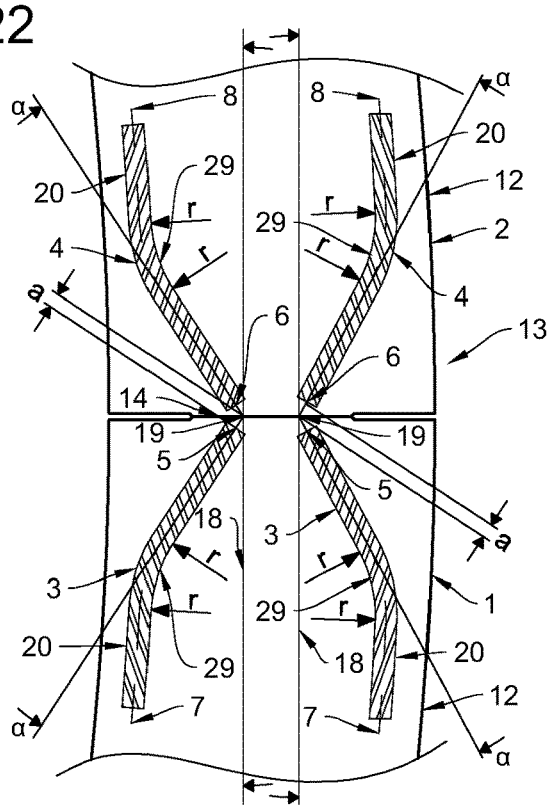
FIG. 22 shows a section corresponding to FIG. 16 through a longitudinal joint produced with the tunnel lining segment according to the invention, in accordance with an eleventh embodiment.

The manufacture of an exemplary longitudinal joint 13 with the tunnel lining segment 12 according to the invention in accordance with an eleventh embodiment is explained in FIG. 22.

In this exemplary embodiment, steel bars 3 or 4 are installed on the inside and outside of the tunnel lining segments 12 in the ring direction in such a way that the areas of the steel bars 3 or 4 further away from the longitudinal joint 13 are located in the same position as the longitudinal reinforcement of the tunnel lining segments 12. The steel bars 3 or 4 each have a bend 29 with a radius r. It is thereby achieved that the end faces 5 or 6 of the steel bars 3 or 4 are arranged close to the load transfer area 14. In this example, the tangents 9 or 10 to the centroidal axes 7 or 8 in the end faces 5 or 6 of the steel bars 6 or 4 have an angle $\alpha$ of 30 degrees to the normal 18 onto the load transfer area 14. In this example, the steel bars 3 or 4 are installed in addition to the longitudinal reinforcement, which is not illustrated in FIG. 22. In the end faces 5 and 6, the normal compressive stresses of the steel bars 3 and 4 are transferred to the concrete of the tunnel lining segments 12. The normal compressive stresses of the steel bars 3 and 4 can be absorbed by the concrete because the concrete in the tunnel lining segments 1 and 2 has a reinforcement in proximity to the load transfer area 14, which reinforcement is laid in the direction of the tunnel lining segment thickness and in the direction of the tunnel lining segment width and is arranged in several planes positioned in parallel to the load transfer area 14. Such a reinforcement laid in a plane parallel to the load transfer area 14 is referred to as a ladder reinforcement. Usually two to four ladder reinforcements are arranged in a tunnel lining segment 12 close to the load transfer areas 14. These ladder reinforcements have the effect that a triaxial compressive stress condition arises when the tunnel lining segment ring 17 is put under strain in proximity to the load transfer area 14. It is known that concrete subjected to triaxial pressure loads is able to absorb compressive stresses that are much higher than the compressive stresses of concrete which are absorbable in a uniaxial compression test.

In proximity to the bends 29, transverse tensile forces arise in the thickness directions, which are to be absorbed by splitting tensile reinforcements. The larger the angle α, the larger the transverse tensile forces to be absorbed. In this example, the angle α is 30 degrees and is therefore in a favourable range. An angle α of 45 degrees will represent the upper limit for a feasible splitting tensile reinforcement.

Figure 23:
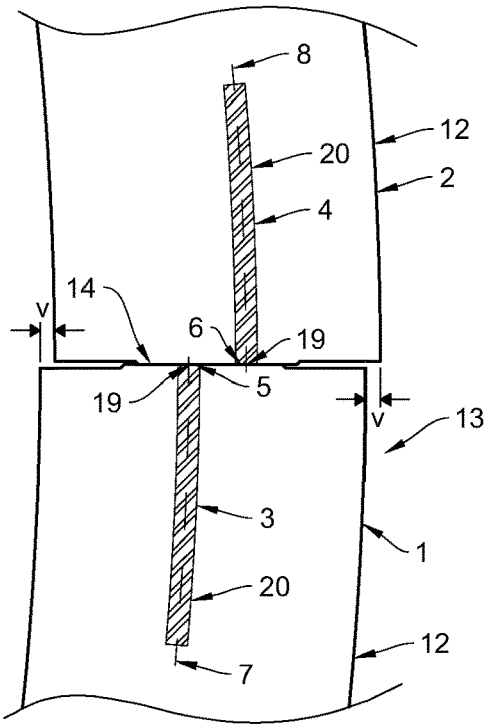
FIG. 23 shows a section corresponding to FIG. 4 through a longitudinal joint produced with the tunnel lining segment according to the invention, in accordance with a twelfth embodiment.

The manufacture of an exemplary longitudinal joint with the tunnel lining segment 12 according to the invention in accordance with a twelfth embodiment is explained in FIG. 23.

In this exemplary embodiment, the first steel bar 3 and the second steel bar 4 have such a large mutual offset that the end faces 5 and 6 of the steel bars 3 and 4 come to lie next to each other in the load transfer area 14 as a result of manufacturing tolerances and positional deviations which may occur during the installation of the tunnel lining segments 12 and because of compressive stresses from the mountains onto the tunnel lining segment ring 17. A direct force transmission from the first steel bar 3 via a contact stress to the second steel bar 4 is therefore not possible in this example. However, experimental studies have shown that it is possible also in this case to transfer the force of the first steel bar 3 into the concrete of the second tunnel lining segment 2 and the force of the second steel bar 4 into the concrete of the first tunnel lining segment 1 when two to four ladder reinforcements are, in each case, tied around the concrete close to the load transfer area 14 in the first tunnel lining segment 1 and in the second tunnel lining segment 2. The force that can be absorbed by the concrete through peak pressure depends on the cross-sectional areas of the reinforcement bars of the ladder reinforcements and, under ideal conditions, can account for more than 90% of the flow force of a first steel bar 3 or a second steel bar 4, resulting from the product of the area and the yield stress of the steel bars 3 or 4.

The length of a steel bar 3 or 4 can advantageously be chosen such that the load capacity of the steel bar 3 or 4 can be introduced into the concrete of the tunnel lining segment 12 via bond stresses along the length of the steel bar 3 or 4.

The yield point of a steel bar can advantageously range between 200 $N/mm^2$ and 1200 $N/mm^2$ and preferably between 500 $N/mm^2$ and 700 $N/mm^2$.

In the exemplary embodiments, the transmission of a normal compressive force across a longitudinal joint 13 between two tunnel lining segments 12 was shown with the tunnel lining segment 12 according to the invention. The transmission of normal compressive forces across the ring joint between two tunnel lining segments 12 is also possible with the tunnel lining segment 12 according to the invention.

LIST OF REFERENCE SYMBOLS

1 first tunnel lining segment
2 second tunnel lining segment
3 first steel bar
4 second steel bar
5 end face of the first steel bar
6 end face of the second steel bar
7 centroidal axis of the first steel bar
8 centroidal axis of the second steel bar
9 tangent to the centroidal axis of the first steel bar
10 tangent to the centroidal axis of the second steel bar
11 tunnel tube
12 tunnel lining segment
13 longitudinal joint
14 load transfer area
15 overpressed zone of the load transfer area
16 edge of the overpressed zone
17 tunnel lining segment ring
18 normal to the load transfer area
19 point of intersection
20 corrugated reinforcing bar
21 expansion
22 formwork
23 filling material
24 cavity
25 mortar
26 end piece
27 plate
28 recess
29 bend

The invention claimed is:

1. A tunnel lining segment made of reinforced concrete, wherein the tunnel lining segment comprises:
- a load transfer area for a longitudinal joint,
- a steel bar with an end face installed in the tunnel lining segment,
- wherein the steel bar is arranged in the tunnel lining segment in such a way that a tangent to a centroidal axis of the steel bar encloses an angle (α) of between 0° and 45° in the end face with a normal to the load transfer area, and
- wherein the end face is arranged at a distance (a) from the load transfer area which is between 0 mm and 10 mm.

2. A tunnel lining segment according to claim 1, wherein the steel bar is a corrugated reinforcing bar.

3. A tunnel lining segment according to claim 1, wherein the steel bar has a bend which essentially corresponds to a bend of the tunnel lining segment.

4. A tunnel lining segment according to claim 1, wherein the steel bar is installed in a center plane of the tunnel lining segment.

5. A tunnel lining segment according to claim 1, wherein the steel bar is installed in the tunnel lining segment in such a way that a concrete cover is provided between a surface of the steel bar and an edge of an overpressed zone of the load transfer area.

6. A tunnel lining segment according to claim 1, wherein the steel bar has a diameter of between 10 mm and 100 mm.

7. A tunnel lining segment according to claim 1, wherein an expansion of the steel bar is provided adjacent to the distance (a).

8. A tunnel lining segment according to claim 7, wherein the expansion is an end piece that has been screwed on the steel bar, a steel plate that has been welded on the steel bar or a thickening of the steel bar.

9. A tunnel lining segment according to claim 1, wherein the steel bar has a length which corresponds to a developed length of the tunnel lining segment minus twice the distance (a).

10. A tunnel lining segment according to claim 7, wherein the expansion of the steel bar is provided only adjacent to the distance (a).

11. A tunnel lining segment according to claim 1, wherein at least two steel bars are installed in the tunnel lining segment, with a common plate being arranged adjacent to the distance (a), wherein the common plate has a higher compressive strength than the concrete of the tunnel lining segment.

12. A tunnel lining segment according to claim 11, wherein the common plate is made of steel and the two steel bars are welded to the plate.

13. A tunnel lining segment according to claim 1, wherein the end face of the steel bar encloses an angle with the centroidal axis of the steel bar, which ranges between 60° and 90°.

14. A tunnel lining segment according to claim 1, wherein the steel bar is a corrugated reinforcing bar which is arranged in a ring direction on the inside and/or the outside of the tunnel lining segment and is configured with two bends in the area of the longitudinal joint so that two different sections of the steel bar run parallel to a circumferential direction of the tunnel lining segment.

15. A tunnel lining segment according to claim 1, wherein a hardened mortar, which has a higher compressive strength than the concrete of the tunnel lining segment, is located at the distance (a).

16. A tunnel lining segment according to claim 1, wherein the tunnel lining segment has a formwork which is at a distance of between 0.1 mm and 50 mm from the end face of the steel bar.

17. A tunnel lining segment according to claim 1, wherein the steel bar, which is arranged in a ring direction on the inside and/or the outside of the tunnel lining segment, comprises a bend in the area of the longitudinal joint so that the end face of the steel bar is at the distance a from the load transfer area.

18. A tunnel lining segment ring comprising at least a first tunnel lining segment and a second tunnel lining segment, each according to claim 1, the load transfer areas of the tunnel lining segments being located, at least partially, opposite one another so that a longitudinal joint is formed between the first and second tunnel lining segment, wherein the tangent to the centroidal axis in the end face of the steel bar of the first tunnel lining segment intersects with the load transfer area at a first point of intersection and wherein the tangent to the centroidal axis in the end face of the steel bar of the second tunnel lining segment intersects with the load transfer area at a second point of intersection, with the first and the second points of intersection being at a distance (b) from one another which is less than 50 mm.

19. A tunnel lining segment ring according to claim 18, wherein the steel bar of the first tunnel lining segment has a different diameter than the steel bar of the second tunnel lining segment.

20. A tunnel lining segment ring according to claim 18, wherein the first and the second tunnel lining segments are arranged relative to each other in such a way that the assembly inaccuracies in a longitudinal joint formed between them are less than 20 mm.

* * * * *